US010253522B2

(12) United States Patent
Choi

(10) Patent No.: US 10,253,522 B2
(45) Date of Patent: Apr. 9, 2019

(54) SHELTER FRAME WITH TRANSVERSE MEMBER

(71) Applicant: Campvalley (Xiamen) Co. Ltd., Xiamen, Fujian Province (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 14/311,564

(22) Filed: Jun. 23, 2014

(65) Prior Publication Data

US 2014/0311540 A1 Oct. 23, 2014

Related U.S. Application Data

(63) Continuation-in-part of application No. PCT/CN2013/089918, filed on Dec. 19, 2013.

(30) Foreign Application Priority Data

Feb. 5, 2013 (CN) ..... 2013 2 0066279 U

(51) Int. Cl.
*E04H 15/48* (2006.01)
*E04H 15/46* (2006.01)
*E04H 15/42* (2006.01)

(52) U.S. Cl.
CPC ..... *E04H 15/48* (2013.01); *E04H 15/46* (2013.01); *E04H 15/42* (2013.01)

(58) Field of Classification Search
CPC ..... E04H 15/46; E04H 15/44; E04H 15/48; E04H 15/52
See application file for complete search history.

(56) References Cited

U.S. PATENT DOCUMENTS

| | | | | |
|---|---|---|---|---|
| 14,655 | A | 4/1856 | Hartwell | |
| 58,283 | A | 9/1866 | Palmer | |
| 379,274 | A | 3/1888 | Hamilton | |
| 910,117 | A | 1/1909 | Crocker | |
| 952,879 | A | 3/1910 | Crocker | |
| 1,061,547 | A | 5/1913 | Kennedy | |
| 1,129,194 | A * | 2/1915 | Henley | 135/140 |
| 1,347,107 | A | 7/1920 | McCann | |
| 1,601,664 | A | 9/1926 | Ackerman | |

(Continued)

FOREIGN PATENT DOCUMENTS

| | | |
|---|---|---|
| CA | 2022369 A1 | 2/1991 |
| CN | 1076987 A | 10/1993 |

(Continued)

OTHER PUBLICATIONS

International Search Report, PCT Application No. PCT/CN2008/073142, dated Jan. 22, 2009.

*Primary Examiner* — David R Dunn
*Assistant Examiner* — Danielle Jackson
(74) *Attorney, Agent, or Firm* — Morgan, Lewis & Bockius LLP

(57) ABSTRACT

Disclosed is a foldable frame for supporting a shelter, e.g., a tent or awning, including a supported tent cloth, top transverse rod, auxiliary top rods, and vertical rods connected to the auxiliary top rods. The frame of the utility model is simple in structure and convenient to use, and the usable area of a shelter supported by the frame can be increased even though the number of rods is not increased.

19 Claims, 6 Drawing Sheets

(56) References Cited

U.S. PATENT DOCUMENTS 1,687,722 A 10/1928 Goldberg
2,113,118 A 4/1938 Pyatt
2,137,625 A 11/1938 Norvell
2,227,554 A 1/1941 Riordon
2,306,706 A 12/1942 Lucas
2,448,895 A 9/1948 Lawrence
2,530,765 A 11/1950 Greenup
2,555,220 A 5/1951 Brown
2,716,993 A 9/1955 Codrick
2,731,972 A 1/1956 Braun
2,948,287 A 8/1960 Rupert
2,962,034 A 11/1960 Finlayson
2,984,249 A 5/1961 Sears, Jr. et al.
3,054,413 A 9/1962 Eshelman
3,333,373 A 8/1967 Taylor et al.
3,454,021 A 7/1969 Morris
3,738,378 A 6/1973 Williams
3,766,932 A 10/1973 Sidis
3,810,482 A 5/1974 Beavers
3,929,146 A 12/1975 Maiken
4,003,181 A 1/1977 Robinson
4,037,978 A 7/1977 Connelly
4,066,089 A 1/1978 Rainwater
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,285,355 A 8/1981 Lundblade
4,627,210 A 12/1986 Beaulieu
4,637,748 A 1/1987 Beavers
4,750,509 A 6/1988 Kim
4,787,182 A 11/1988 Serge
4,819,680 A 4/1989 Beavers
4,827,958 A 5/1989 Cantwell
4,838,003 A 6/1989 Zeigler
4,941,499 A 7/1990 Pelsue et al.
4,944,321 A 7/1990 Moyet-Ortiz
4,971,090 A 11/1990 Uhl
4,998,552 A * 3/1991 Niksic ..... E04B 1/3441 135/136
5,230,358 A 7/1993 Forell
5,240,020 A 8/1993 Byers
5,255,698 A 10/1993 Riley
5,263,507 A * 11/1993 Chuang ..... 135/140
5,293,890 A 3/1994 Park et al.
5,328,286 A 7/1994 Lee
5,333,634 A 8/1994 Taylor
5,361,794 A 11/1994 Brady
5,421,355 A 6/1995 Cantwell
5,423,341 A 6/1995 Brady
5,617,681 A 4/1997 Lyons
5,628,338 A 5/1997 Stumbo
5,634,483 A 6/1997 Gwin
5,666,986 A 9/1997 Fox
5,701,923 A 12/1997 Losi, Jr. et al.
5,732,726 A 3/1998 Lee
5,771,651 A * 6/1998 Shiina ..... E04H 15/48 135/143
5,797,695 A 8/1998 Prusmack
5,884,646 A 3/1999 Ju
5,943,837 A 8/1999 Esser et al.
6,021,795 A 2/2000 Long et al.
6,032,430 A 3/2000 Soukup
6,167,898 B1 1/2001 Larga et al.
6,230,728 B1 5/2001 Reese
6,283,136 B1 * 9/2001 Chen ..... 135/144
6,286,530 B1 9/2001 Hussey
6,296,415 B1 10/2001 Johnson et al.
6,463,948 B2 10/2002 Lee
6,516,823 B1 2/2003 Glover et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 8/2004 Chen
6,854,476 B1 2/2005 Chai
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,299,813 B2 11/2007 Ochi
7,311,113 B2 12/2007 Suh
7,316,239 B2 1/2008 Yang
7,392,610 B2 7/2008 Jedlicka
RE40,544 E 10/2008 Suh
7,481,235 B2 1/2009 Prusmack
7,546,845 B2 6/2009 Prusmack
7,607,447 B1 10/2009 Han
7,628,165 B2 12/2009 Rothwell
7,656,024 B2 2/2010 Elbanhawy
7,686,024 B1 3/2010 Lai
7,810,514 B2 10/2010 Lah
7,861,736 B2 1/2011 Choi
7,891,367 B2 2/2011 Ma
8,033,289 B2 * 10/2011 Buckley ..... E04H 15/46 135/114
8,047,218 B1 11/2011 Shin
8,056,573 B2 11/2011 Panigot
8,069,872 B2 12/2011 Bae
8,156,952 B2 4/2012 Chesness
8,186,369 B2 5/2012 Reeb
8,469,045 B2 6/2013 Zhou
8,485,208 B2 7/2013 Seo
8,580,554 B2 11/2013 Choi
D705,884 S 5/2014 Jin
8,763,621 B2 7/2014 Jin
8,869,814 B2 10/2014 Jin
8,910,648 B2 12/2014 Jin
8,919,364 B1 12/2014 Russell
9,051,034 B1 6/2015 Li
9,140,030 B2 9/2015 Jin
9,192,215 B2 11/2015 Ma
9,243,423 B2 1/2016 Jin
9,243,424 B2 1/2016 Jin
9,382,723 B2 7/2016 Choi
2001/0050098 A1 12/2001 Lee
2003/0005953 A1 1/2003 Erbetta et al.
2006/0016467 A1 1/2006 Bae
2006/0289048 A1 12/2006 Choi
2007/0051399 A1 3/2007 Jung
2007/0215192 A1 9/2007 Hoffman
2008/0223425 A1 9/2008 Shumate
2009/0173369 A1 7/2009 Lab
2012/0055525 A1 3/2012 Choi
2012/0318316 A1 12/2012 Choi et al.
2013/0014794 A1 1/2013 Jin
2013/0247948 A1 9/2013 Lovely et al.
2013/0318316 A1 11/2013 Yamada
2014/0076371 A1 3/2014 Jin
2014/0076372 A1 * 3/2014 Jin ..... 135/139
2014/0109945 A1 4/2014 Jin
2014/0246062 A1 9/2014 Ma
2014/0261601 A1 9/2014 Jin
2014/0290710 A1 10/2014 Choi
2014/0311540 A1 10/2014 Choi
2015/0068573 A1 * 3/2015 Jin ..... 135/147
2015/0083177 A1 3/2015 Hotes
2015/0167343 A1 6/2015 Fang
2015/0167344 A1 6/2015 Li
2015/0275541 A1 10/2015 Lamke
2015/0284974 A1 10/2015 Choi
2016/0060897 A1 3/2016 Baoqing
2016/0242567 A1 8/2016 Lime
2016/0281385 A1 9/2016 Choi
2016/0290003 A1 10/2016 Yang

FOREIGN PATENT DOCUMENTS

CN 1030790 C 1/1996
CN 2401649 Y 10/2000

(56) References Cited

FOREIGN PATENT DOCUMENTS

| | | | | |
|---|---|---|---|---|
| CN | 2506736 | Y | | 8/2002 |
| CN | 2635827 | Y | | 8/2004 |
| CN | 2697225 | Y | | 5/2005 |
| CN | 201013097 | Y | | 1/2008 |
| CN | 201103269 | Y | | 8/2008 |
| CN | 201129060 | Y | | 10/2008 |
| CN | 201202302 | Y | | 3/2009 |
| CN | 201695751 | U | * | 1/2011 |
| CN | 102691439 | A | | 9/2012 |
| CN | 201220478761.4 | | * | 9/2012 |
| CN | 202767622 | U | | 3/2013 |
| CN | 203034904 | U | | 7/2013 |
| CN | 103590650 | B | | 2/2014 |
| CN | 204163467 | U | | 2/2015 |
| FR | 1 121 851 | | | 8/1956 |
| FR | 68588 | | | 5/1958 |
| GB | 2201703 | A | | 9/1988 |
| GB | 2259927 | A | | 3/1993 |
| GB | 2535221 | A | | 8/2016 |
| KR | 10-2011-0054253 | A | | 5/2011 |
| WO | WO 2011/022764 | A1 | | 3/2011 |
| WO | WO 2013/116545 | A1 | | 8/2013 |
| WO | WO 2014/181853 | A1 | | 11/2014 |

* cited by examiner

SHELTER FRAME WITH TRANSVERSE MEMBER

CROSS-REFERENCE TO RELATED APPLICATION

The present application claims priority to PCT/CN2013/089918, filed Dec. 19, 2013, which claims priority to Chinese Patent Application No. CN 2013-20066279.4 filed on Feb. 5, 2013, the entire contents of which applications are incorporated herein for all purpose by this reference.

FIELD

The utility model relates to outdoor leisure products, and particularly to a shelter frame.

BACKGROUND

Collapsible shelters (e.g., tents or awnings) are among the leisure products which are ever prepared for outdoor use. However, as for a relatively large tent or awning, it is required for several persons to unfold the tent or awning successfully due to its bulky and heavy nature. Accordingly, various supporting structures have been designed to facilitate unfolding the tent or awning.

As outdoor equipment, the tent has currently become an essential item for people who enjoy outdoor and leisure activities like traveling, camping, or the like to experience nature. Currently there are various tents for outdoor applications. There are large and small tent sizes, and square, round, and hexagonal shapes. The tent primarily includes a tent cloth and a tent frame for supporting the tent cloth. The common tent frame generally includes several groups of supporting rods or poles that connect to a top rod. The top rod provides support for the top of the tent. However, the tent known in the art has the following drawbacks. Tents are usually complicated in structure. In some tents, a pivoting seat is arranged at the top of the tent to connect several tent top rods for the purpose of unfolding the tent and increasing its usable area. However, such a tent is relatively heavy and large area tents require many supporting rods. It is difficult and time consuming to support and put up such tents. Besides, the manufacturing cost is increased.

DETAILED DESCRIPTION

The utility model will be described hereinafter in detail with reference to specific embodiments to provide a further understanding of the technical solution of the utility model.

Figure 1:
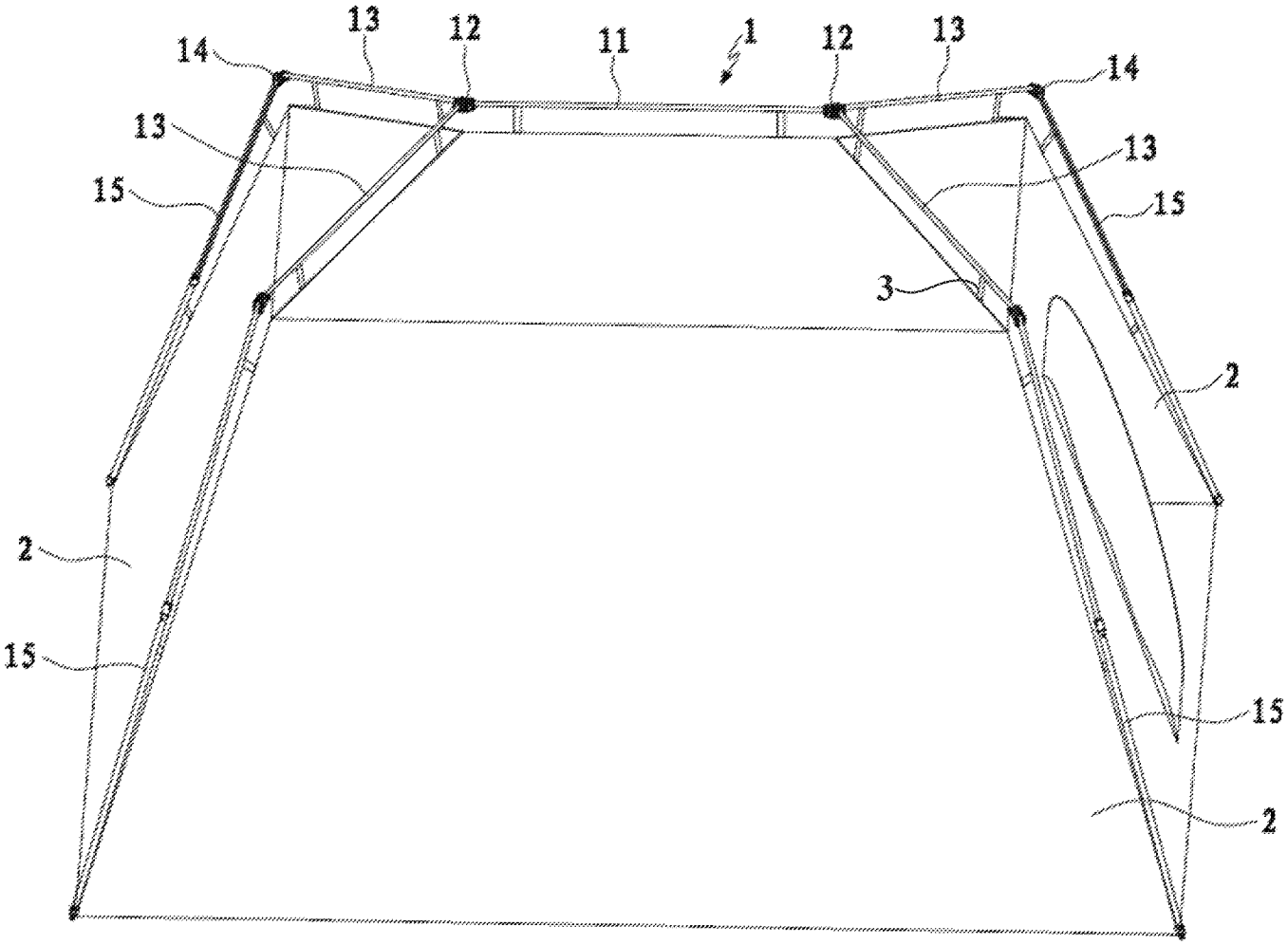
FIG. 1 is a diagram for a frame of the utility model in use.
Figure 2:
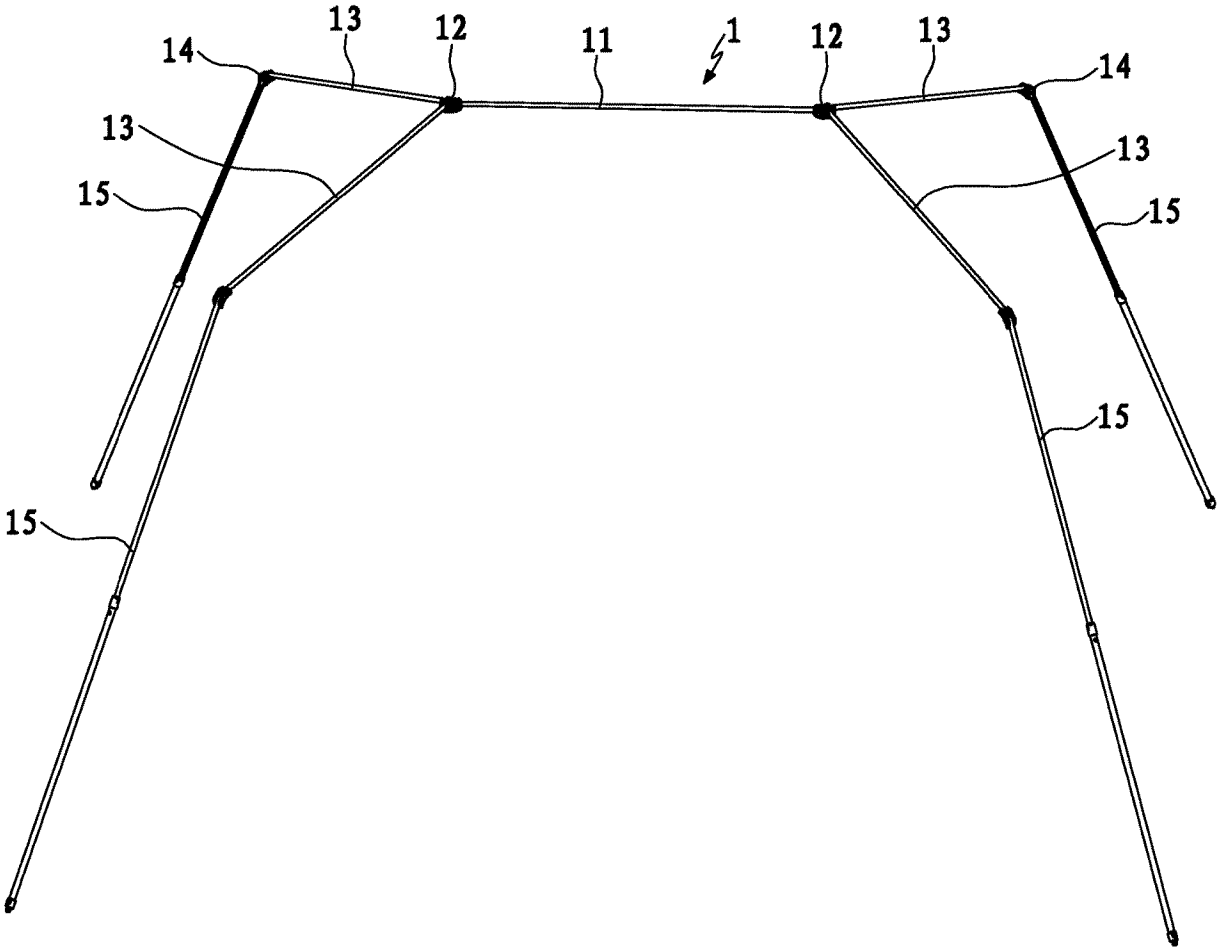
FIG. 2 is a structural diagram for the frame of the utility model in an unfolded state.

FIGS. 1 and 2 depict a collapsible shelter in accordance with one embodiment. The shelter includes a frame 1 connected to a cloth 2 that cooperates with the unfolding and folding of the frame.

In one embodiment, frame 1 includes a straight, top transverse rod 11 having first and second ends at a top portion of frame 1. First and second auxiliary top rods 13 connect at a first (inner) end to the first end of top transverse rod 11 through a first three-way connector 12. The first ends of third and fourth auxiliary top rods 13 connect to the second end of top transverse rod 11 through a second three-way connector 12. Three-way connector 12 allows top transverse rod 11 and auxiliary top rods 13 to fold toward one another in a first direction to fold the frame into a folded state. A second (outer) end of the first, second, third, and fourth auxiliary rods 13 are connected respectively to a first end of first, second, third, and fourth vertical rods 15 respectively through first, second, third, and fourth connectors 14. Vertical rods 15 may be comprised of telescopic sleeves. In one embodiment, top transverse rod 11 includes multiple sections, (e.g., a multi-section rod) (FIG. 4), comprising a first transverse section and a second transverse section, and a connector (not shown) disposed between the first and second transverse sections. A multi-section rod allows the space at the top portion of a shelter supported by frame 1 to be extended when frame 1 is in an unfolded state, and compressed when frame 1 is in a folded state. The sections of top transverse rod 11 are telescopic in the embodiment of FIG. 4. In other embodiments, the sections of top transverse rod 11 may be interconnected by various types of connectors. In this way, the length of top transverse rod 11 may be advantageously increased. Further, auxiliary top rods 13 may also be telescopic to increase the area within a shelter supported by frame 1 in an unfolded state, and may be directly folded when frame 1 is in a folded state, thus facilitating a small volume when the frame is folded. Top transverse rod 11 is shown telescoped in FIG. 4, whereas each of auxiliary top rods 13 and vertical rods 15 is depicted in an un-telescoped (e.g., collapsed) state.

In this manner, the top transverse rod 11 of the frame is connected with two auxiliary top rods 13 that extend outward. Each auxiliary top rod 13 is connected with a vertical rod 15 through the connector 14 which allows auxiliary top rod 13 and vertical rod 15 to fold toward one another in a second direction to fold the frame into a folded state. Four vertical rods 15 support the top surface formed by auxiliary top rods 13 and top transverse rod 11. The shape of cloth 2 matches the shape of unfolded frame 1, and is supported by the unfolded frame using a plurality of sleeves 3. The cloth 2 is supported by the unfolded frame 1 so that the cloth 2 is below the frame 1. The plurality of sleeves 3 couple the cloth 2 to the frame 1 at the top transverse rod 11, the auxiliary top rods 13, and the vertical rods 15, as shown in FIG. 1. The cloth 2 is further stretched and unfolded in the frame 1.

Figure 3:
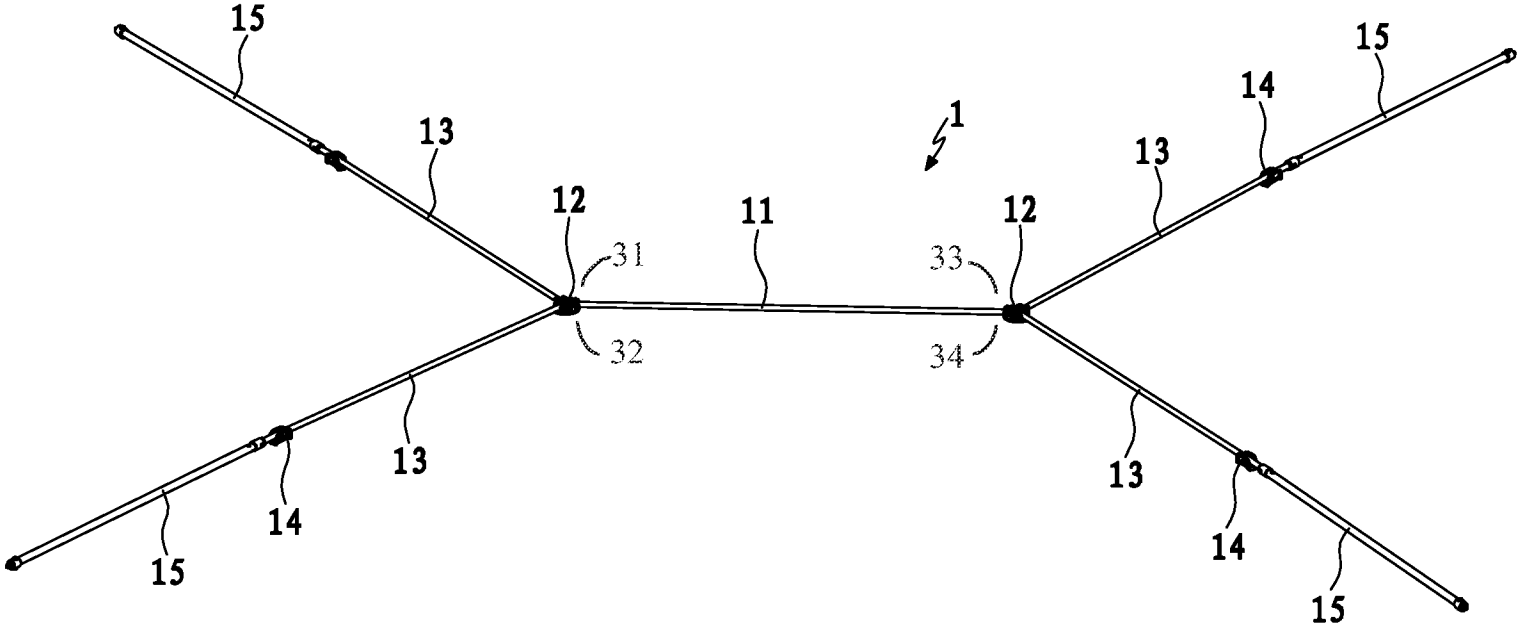
FIG. 3 is a structural diagram for the frame of the utility model in a half folded state.
Figure 4:
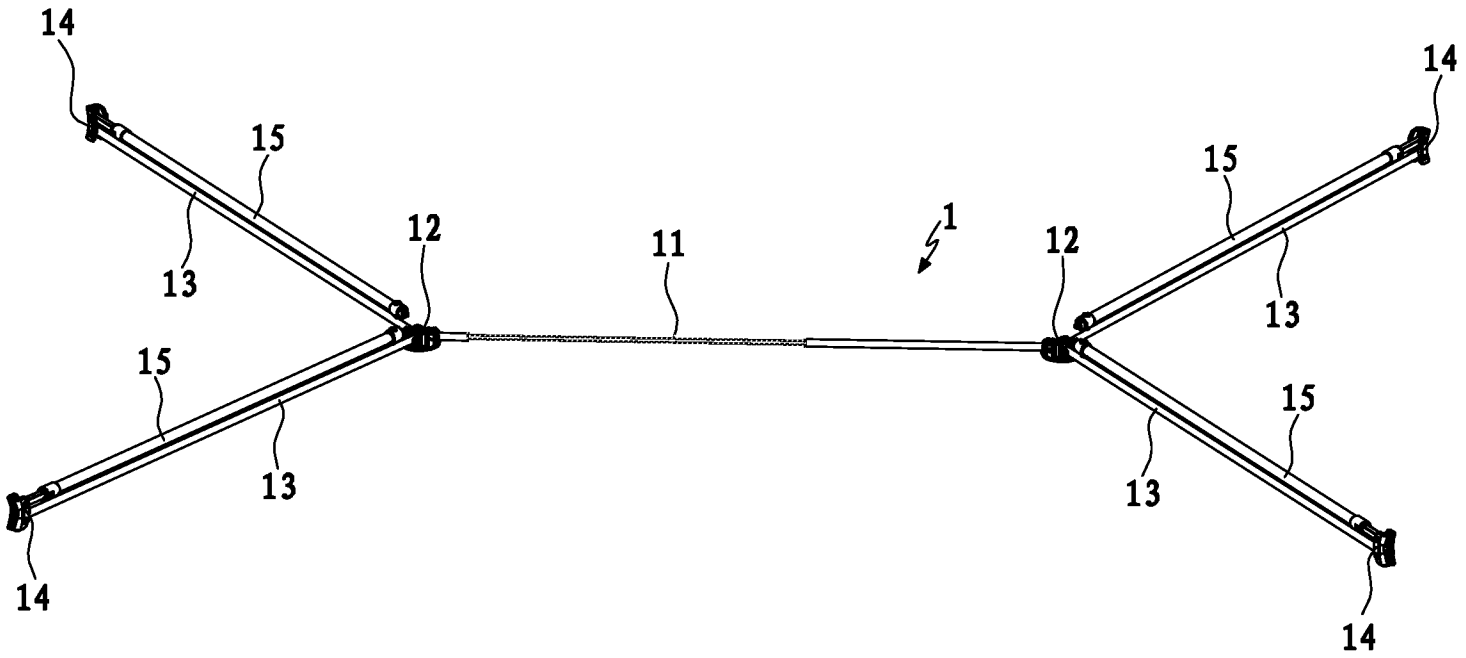
FIG. 4 is a structural diagram for the frame of the utility model in a further folded state.
Figure 5:
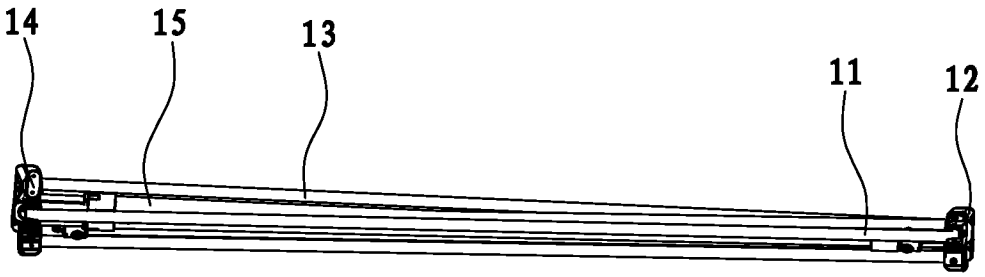
FIG. 5 is a structural diagram for the frame of the utility model in a folded state.

The frame of the utility model is simple in structure, and is convenient and quick to fold. To fold frame 1 in one embodiment, vertical rods 15 are firstly contracted, as shown in FIG. 3. Then the contracted vertical rods 15 are folded upward to lean against auxiliary top rods 13, as shown in FIG. 4. Finally, each group of vertical rods 15 and auxiliary top rods 13 which have leaned against one other is folded to lean against the top transverse rod 11, as shown in FIG. 5. In another embodiment, top transverse rod 11 includes multiple sections and auxiliary top rods 13 include telescopic sleeves. The top transverse rod 11 is contracted into a relatively short rod, and auxiliary top rods 13 are also contracted. As a result, top transverse rod 11 and auxiliary top rods 13 are minimized in volume when the frame is in a folded state. The frame in the folded state exhibits minimum volume, is able to be stored conveniently, and is easy to carry.

Figure 6:
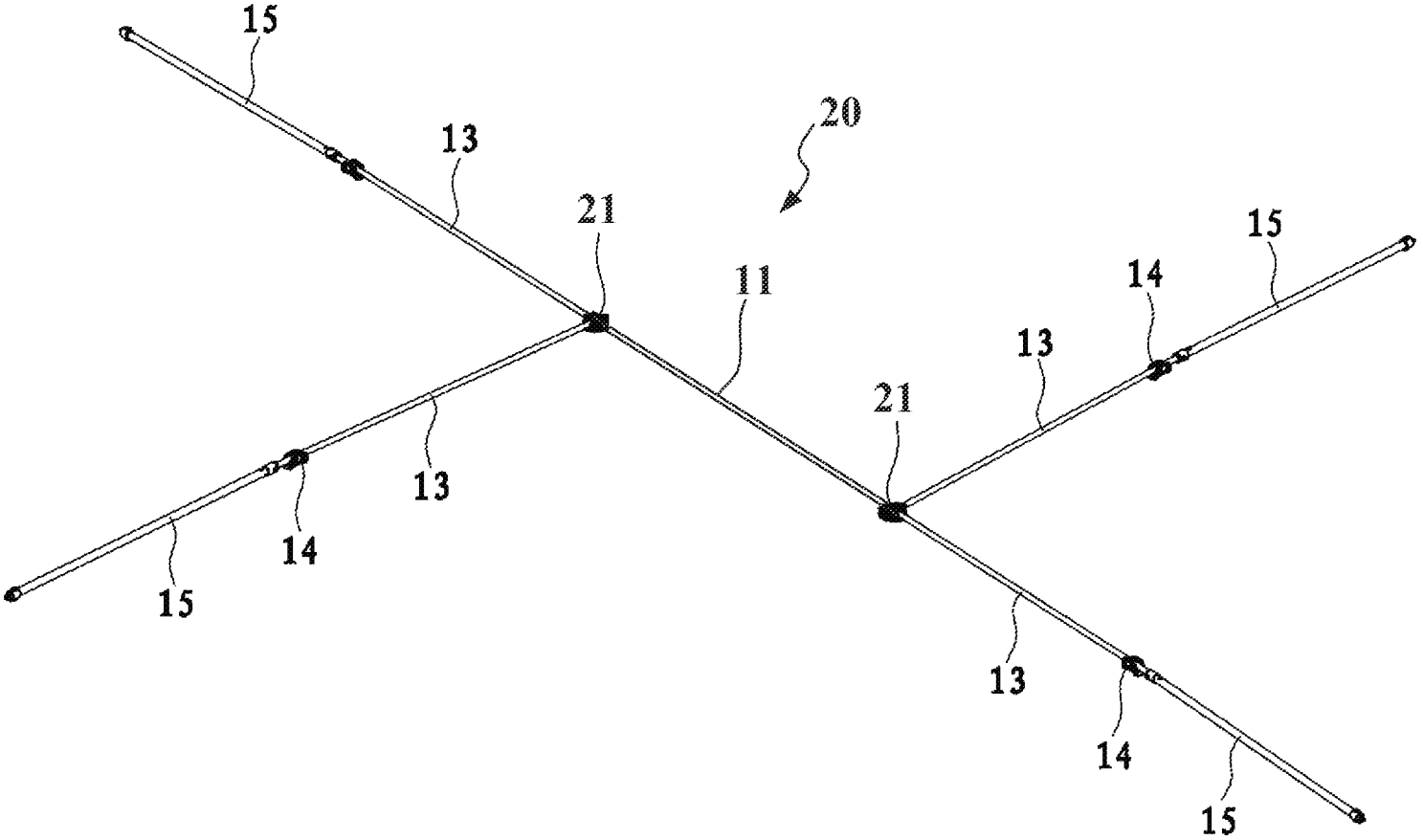
FIG. 6 is a structural diagram for the frame of the utility model in a half folded state, depicting alternative three-way connectors.

FIG. 6 is a top view of a frame 20 in accordance with another embodiment. Frame 20 is similar to frame 1, detailed above, with like-identified elements being the same or similar. As in frame 1, frame 20 includes first, second, third, and fourth spreading angles (depicted in FIG. 3 respectively at 31, 32, 33, and 34) formed between top transverse rod 11 and respectively first, second, third, and fourth auxiliary top rods 13. Spreading angles are determined from the perspective of a top view (also referred to as a "plan view") of frame 1 or frame 20 in the unfolded state. Frame 20 differs from frame 1 in that first spreading angle 31 and second angle 32 may be unequal, and third spreading angle 33 and fourth spreading angle 34 may be unequal. In one embodiment, symmetry of the frame with respect to the elongated axis of top transverse rod 11 may be achieved by making equal first and third spreading angles 31 and 33, and by making equal second and fourth spreading angles 32 and 34. Angles differing from one another by more than 5% of the smaller angle are unequal. In one embodiment, three-way connector 21, depicted in FIG. 6, is disposed in place of three-way connector 12 to facilitate unequal spreading angles.

In the frame of the utility model, it is not necessary to arrange a top connecting seat at the top surface of the frame. Instead, at least two auxiliary top rods 13 which spread outward are connected at first and second ends of the top transverse rod 11 to form a supporting surface at the top of the frame. Each auxiliary top rod 13 is connected with a vertical rod 15 to form a standing support. The top transverse rod 11 and the auxiliary top rods 13 can also increase the length and usable space of a shelter supported by the frame. The auxiliary top rods 13 with a spreading angle unfold the top cloth at first and second ends of the top transverse rod, so as to form a shelter possessing a certain internal space. The frame of the utility model is simple in structure, and the usable area of a shelter supported by the frame can be increased without adding supporting rods. In addition, the frame is simple in structure, easy to put up and fold, and convenient to use.

Although the invention has been described in connection with specific embodiments, variations of these embodiments will be obvious to those of ordinary skill in the art. For example, control structures and related components for t, adjusting spreading angles, and the like can be used to advantage, e.g., for other types of collapsible devices and shelters such as portable awnings, gazebos, screen houses, sunshades, umbrellas, strollers, and cribs. Other modifications and variations likewise fall within the scope of the appended claims. Therefore, the spirit and scope of the claims should not be limited to the foregoing description.

Only those claims specifically reciting "means for" or "step for" should be construed in the manner required under the sixth paragraph of 35 U.S.C. § 112.

What is claimed is:

1. A tent frame comprising:

a top transverse rod having a first end and a second end;

first, second, third and fourth auxiliary top rods, each having first and second ends;

first and second connectors, wherein the first connector pivotally connects the first end of the top transverse rod and the first ends of the first and second auxiliary top rods, and the second connector pivotally connects the second end of the top transverse rod and the first ends of the third and fourth auxiliary top rods;

first, second, third, and fourth vertical rods each having first and second ends; and first, second, third, and fourth two-way connectors, each respective two-way connector in the first, second, third, and fourth two-way connectors corresponding to one vertical rod in the first, second, third, and fourth vertical rods and one auxiliary top rod in the first, second, third, and fourth auxiliary top rods, wherein the first end of the one vertical rod is pivotally connected to the respective two way connector and the second end of the one auxiliary top rod is pivotally connected to the respective two way connector such that the one vertical rod and the one auxiliary top rod are rotatable toward or away from each other within a plane defined by the one vertical rod and the one auxiliary top rod, and between a folded angle and an unfolded angle, wherein the unfolded angle is larger than 180 degrees, wherein the first end of the top transverse rod is pivotally connected with only the first ends of the first and second auxiliary top rods, and the second end of the top transverse rod is pivotally connected with only the first ends of the third and fourth auxiliary top rods, and wherein each of the first, second, third, and fourth vertical rods is foldable to its corresponding auxiliary top rod when connected with each other, and each group of folded vertical and auxiliary rods is foldable to the top transverse rod when connected with each other.

2. The tent frame of claim 1, wherein:

first, second, third, and fourth spreading angles are formed between the top transverse rod and respectively the first, second, third, and fourth auxiliary top rods, when the tent frame is unfolded, the first spreading angle and the third spreading angle are equal, and the second spreading angle and the fourth spreading angle are equal.

3. The tent frame of claim 1, wherein the auxiliary top rods are telescopic.

4. The tent frame of claim 1, wherein the vertical rods are telescopic.

5. The tent frame of claim 1, wherein the top transverse rod is a multi-section rod comprised of a first transverse section and a second transverse section.

6. The tent frame of claim 5, further comprising a fourth connector disposed between the first and second transverse sections.

7. The tent frame of claim 5, wherein the top transverse rod is telescopic.

8. A tent comprising: a tent frame of claim 1 and a tent cloth to be coupled with and supported by the tent frame.

9. A tent frame comprising:

a top transverse rod having a first end and a second end;

first, second, third and fourth auxiliary top rods, each having first and second ends;

first, second, third, and fourth vertical rods each having first and second ends;

a first connector pivotally connecting the first end of the top transverse rod and the first ends of the first and second auxiliary top rods;

a second connector pivotally connecting the second end of the top transverse rod and the first ends of the third and fourth auxiliary top rods;

a first two-way connector pivotally connecting the second end of the first auxiliary top rod and the first end of the first vertical rod;

a second two-way connector pivotally connecting the second end of the second auxiliary top rod and the first end of the second vertical rod;

a third two-way connector pivotally connecting the second end of the third auxiliary top rod and the first end of the third vertical rod; and a fourth two-way connector pivotally connecting the second end of the fourth auxiliary top rod and the first end of the fourth vertical rod, wherein the first end of the top transverse rod is pivotally connected with only the first ends of the first and second auxiliary top rods, and the second end of the top transverse rod is pivotally connected with only the first ends of the third and fourth auxiliary top rods, and wherein each of the first, second, third, and fourth vertical rods is foldable to its corresponding auxiliary top rod when connected with each other, and each group of folded vertical and auxiliary rods is foldable to the top transverse rod when connected with each other.

10. The tent frame of claim 9, wherein the first and second connectors are configured such that for each auxiliary top rod, the auxiliary top rod and the top transverse rod fold toward one another in only a first direction to fold the tent frame into the folded state.

11. The tent frame of claim 10, wherein the two-way connectors are configured such that for each auxiliary top rod, the auxiliary top rod and its corresponding vertical rod fold toward one another in only a second direction to fold the tent frame into the folded state.

12. The tent frame of claim 11, wherein the first and second directions are different.

13. The tent frame of claim 9, wherein:

first, second, third, and fourth spreading angles are formed between the top transverse rod and respectively the first, second, third, and fourth auxiliary top rods, when the tent frame is unfolded, the first spreading angle and the third spreading angle are equal, and the second spreading angle and the fourth spreading angle are equal.

14. The tent frame of claim 9, wherein the auxiliary top rods are telescopic.

15. The tent frame of claim 9, wherein the vertical rods are telescopic.

16. The tent frame of claim 9, wherein the top transverse rod is a multi-section rod comprised of a first transverse section and a second transverse section.

17. The tent frame of claim 16, further comprising a fourth connector disposed between the first and second transverse sections.

18. The tent frame of claim 16, wherein the top transverse rod is telescopic.

19. A tent comprising: a tent frame of claim 9 and a tent cloth to be coupled with and supported by the tent frame.

* * * * *